United States Patent [19]

Berg et al.

[11] 3,996,392

[45] Dec. 7, 1976

[54] HUMIDITY-INSENSITIVE FERRITE DEVELOPER MATERIALS

[75] Inventors: Allan C. Berg, Rochester; John W. Fitzpatrick, Fairport; Lewis O. Jones, Webster, all of N.Y.

[73] Assignee: Xerox Corporation, Stamford, Conn.

[22] Filed: Oct. 29, 1975

[21] Appl. No.: 626,906

[52] U.S. Cl. ..... 427/19; 96/1 SD; 252/62.1 P; 252/62.53; 252/62.54; 252/62.6; 252/62.61; 427/14; 427/18; 428/407; 428/900

[51] Int. Cl.[2] ..... G03G 13/09; G03G 9/14; H01F 1/37

[58] Field of Search ..... 427/18, 14, 19; 96/1 SD; 252/62.1 P, 62.53, 62.54, 62.6, 62.61; 428/407, 900

[56] References Cited

UNITED STATES PATENTS

| | | | |
|---|---|---|---|
| 3,839,029 | 10/1974 | Berg et al. | 96/1 SD |
| 3,914,181 | 10/1975 | Berg et al. | 252/62.1 P |
| 3,929,657 | 12/1975 | Jones | 252/62.1 P |

*Primary Examiner*—James R. Hoffman

[57] ABSTRACT

Humidity-insensitive electrostatographic ferrite carrier materials having an average particle diameter from between about 30 to about 1,000 microns prepared by blending an essentially stoichiometric mixture of ferrite forming metal oxides, calcining the blended oxides to provide the blended oxides with a saturation magnetic moment of between about 6 to about 30 electromagnetic units per gram, milling the calcined oxides in a slurry to reduce their particle size, adding manganese oxide, copper oxide, sodium-free deflocculant, and water to the slurry to provide a slurry having about 80.0 percent by weight of solids, pumping the slurry to hold-/feed tanks with continuous mixing while adding a binder material, spray-drying the slurry, screening the particles, firing the particles to provide them with a saturation magnetic moment of about 48 electromagnetic units per gram, deagglomerating the particles, and screening the particles to obtain ferrite particles characterized as having surface sodium in an amount of less than about 20 parts per million, surface zinc in an amount of less than about 5,000 parts per million, and a BET surface area of between about 170 $cm^2$/gram and about 500 $cm^2$/gram.

14 Claims, No Drawings

HUMIDITY-INSENSITIVE FERRITE DEVELOPER MATERIALS

BACKGROUND OF THE INVENTION

This invention relates in general to electrostatography, and, in particular, to a process for the production of improved ferrite electrostatographic carrier materials and their use.

The formation and development of images on the surface of photoconductor materials by electrostatic means is well known. The basic electrostatographic imaging process, as taught by C. F. Carlson in U.S. Pat No. 2,297,691, involves placing a uniform electrostatic charge on a photoconductive insulating layer, exposing the layer to a light-and-shadow image to dissipate the charge on the areas of the layer exposed to the light and developing the electrostatic latent image by depositing on the image a finely divided electroscopic material referred to in the art as "toner". The toner will normally be attracted to those areas of the layer which retain a charge, thereby forming a toner image corresponding to the electrostatic latent image. This powder image may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in image configuration. The powder image may be fixed to the photoconductive layer if elimination of the powder image transfer step is desired. Other suitable fixing means such as solvent or overcoating treatment may be substituted for the foregoing heat fixing steps.

Several methods are known for applying the elctroscopic particles to the electrostatic latent image to be developed. One development method, as disclosed by E. N. Wise in U.S. Pat. No. 2,618,552, is known as "cascade" development. In this method, a developer material comprising relatively large carrier particles having finely-divided toner particles electrostatically coated thereon is conveyed to and rolled or cascaded across the electrostatic latent image bearing surface. The composition of the carrier particles is so selected as to triboelectrically charge the toner particles to the desired polarity. As the mixture cascades or rolls across the image bearing surface, the toner particles are electrostatically deposited and secured to the charged portion of the latent image and are not deposited on the uncharged or background portions of the image. Most of the toner particles accidentially deposited in the background are removed by the rolling carrier, due apparently, to the greater electrostatic attraction between the toner and the carrier than between the toner and the discharged background. The carrier and excess toner are then recycled. This technique is extremely good for the development of line copy images.

Another method of developing electrostatic latent images is the "magnetic brush" development process as disclosed for example, in U.S. Pat. No. 2,874,063. In this method, a developer material containing toner and magnetic carrier particles are carried by a magnet. The magnetic field of the magnet causes alignment of the magnetic carrier into a brushlike configuration. This "magnetic brush" is engaged with the electrostatic image-bearing surface and the toner particles are drawn from the brush to the latent image by electrostatic attraction. Thus, a developer mixture may be provided comprising a toner material and a carrier material which consists of particles which are magnetically attractable. Consequently, iron and magnetic ferrite materials have been employed as the carrier material in the electrostatographic arts.

Generally, in cascade or magnetic brush development typical carrier core materials include sodium chloride, ammonium chloride, aluminum potassium chloride, Rochelle salt, sodium nitrate, potassium chlorate, granular zircon, granular silicon, methyl methacrylate, glass, silicon dioxide, flintshot, iron, steel, ferrite, nickel, carborundum and mixtures thereof. Many of the foregoing and other typical carriers are described by L. E. Walkup in U.S. Pat. No. 2,618,551; L. E. Walkup et al. in U.S. Pat. No. 2,638,416 and E. N. Wise in U.S. Pat. No. 2,618,552. Generally, an average carrier particle diameter between about 30 microns to about 1,000 microns is preferred for electrostatographic use because the carrier particle then possesses sufficient density and inertia to avoid adherence to the electrostatic latent images during the cascade development process. In magnetic brush development, the ferrite carrier materials are generally homogenous, rounded or irregularly shaped particles having nominal particle sizes less than about 300 microns and more preferably between about 50 and 150 microns, the latter size range providing optimum image quality during extended use.

Ferrite materials are gaining ever increasing importance in the electronics industry and in the electrostatographic arts. Their use as low conductivity magnetic core materials and as carrier materials for photoconductive insulating materials is well known. Briefly, ferrites may be described in general as compounds of magnetic oxides containing iron as a major metallic component. Thus, compounds of ferric oxide, $Fe_2O_3$, formed with basic metallic oxides having the general formula $MFeO_2$ or $MFe_2O_4$ where M represents a mono or divalent metal and the iron is in the oxidation state of +3 are ferrites. Ferrites are also referred to as ferrospinels since they have the same crystal structure of the mineral spinel $MgAl_2O_4$. However, not all ferrites are magnetic such as, for example, $ZnFe_2O_4$ and $CdFe_2O_4$. This lack of magnetic property is due to the configuration of the ferrite lattice structure. Further, some ferrites, such as magnetobarite, $BaFe_{12}O_{19}$, which exhibit permanent magnetic properites are referred to as "hard" ferrites. A "hard" ferrite is difficult to magnetize and demagnetize and thus is the type of ferrite that is desirable in a permanent magnet. A "soft" ferrite has the opposite property; it is easily magnetized and demagnetized. The "softer" the ferrite material is, the better it is suited to various electrical devices in which magnetization must be reversed very often per unit of time. If one plots the characteristics of a "hard" ferrite and a "soft" ferrite on a graph in which the imposed magnetic field forms the horizontal axis and the total magnetization forms the vertical axis, one obtains a characteristic curve resembling a thick S known as a hysteresis loop. A "hard" ferrite has a wide hysteresis loop and a "soft" ferrite has a thin one. Since each traversal of a loop represents energy lost, a narrow loop is desirable in devices in which magnetization must be reversed frequently.

The ferrite materials of main interest in the electrostatographic arts are the soft ferrites. The soft ferrites may further be characterized as being magnetic, polycrystalline, highly resistive ceramic materials exemplified by intimate mixtures of nickel, manganese, magnesium, zinc, iron or other suitable metal oxides with iron oxide. Upon firing or sintering, the oxide mixtures assume a particular lattice structure which governs the magnetic and electrical properties of the resulting ferrite.

In the past, ferrite materials have generally been prepared by dry and wet methods. The dry method involves the intimate mixing of pure oxides or carbonates of the desired metallic constituents and causing the mixture to react at elevated temperatures to form the desired structure. This method requires extensive ball-milling of the oxides or carbonates, usually dispersed in a liquid, until an efficient degree of mixing is obtained. The mixture is usually then dried, granulated, pre-sintered to form the desired structure, reground to attain a suitable particle size distribution, pressed or compacted with a binder material, and finally sintered or refired at temperatures above the pre-sintering temperature. The wet method generally involves the formation of an intimate mixture of the desired components by co-precipitation from solution. Usually, the components are dissolved as nitrates and co-precipitated as hydroxides, carbonates or oxalates. The product, after filtration and washing, is then prefired, reground, sized, compacted with a binder, and finally sintered or refired at temperatures above the pre-sintering temperature.

Several methods of preparing a manganese-zinc-ferrite are disclosed. For example, in U.S. Pat. No. 3,567,641, an oxide mixture is prepared, the mixture is pre-sintered at about 700° –900° C. for about an hour, the pre-sintered mixture is wet ground with CaO, the material is pressed to shape and sintered at 1,100° –1,300° C. for 1 to 4 hours in a low oxygen atmosphere, and then cooled in a substantially pure neutral atmosphere such as nitrogen. In U.S. Pat. No. 3,565,806 a ferrite material is produced by providing a mixture of the oxides, forming ferrite blanks from the oxide mixture, sintering the ferrite blanks at 1,200° –1,300° C. for about 4 to 20 hours, and during the last half of the sintering period the sintering occurs in an inert gas atmosphere containing less than 0.2 percent by volume of oxygen, and then cooling the sintered ferrite blanks to a temperature of about 300° C. in the same inert atmosphere. In U.S. Pat. No. 3,839,029, Berg et al. teach a spray-drying process wherein a slurry of metal oxides is prepared in a liquid, the slurry is spray-dried to form spherical beads, and the beads are sintered to form ferrite beads. When employing a rotary kiln during the sintering step, a flow-promoting ingredient selected from aluminum oxide and zirconium oxide is mixed with the spray-dried beads to minimize bead-to-bead agglomeration and adherence of the beads to the furnace walls.

However, all of the aforementioned processes suffer from various disadvantages. More particularly, it has been found that thus-prepared ferrite materials when employed in an electrostatographic system for the development of electrostatic latent images are too sensitive to relative humidity changes to be acceptable for use in high speed electrostatographic devices employing magnetic brush development. One of the main reasons for poor performance of the ferrite materials at high humidity in the electrostatographic device was found to be the presence of certain species on the surface of the ferrite particles which changed surface conductivity and dielectric loss, and caused variations in charge relaxation of a developer mixture. The exact mechanism of this phenomenon and the identification of all contributing surface species is not now fully known. However, it has been found that surface sodium, perhaps combined with sulfate, is a major contributory contaminant. Surface zinc oxide has been found to be another major contaminant. Other contaminants may be calcium and potassium. However, sodium and zinc oxide are found to be present in by far the greatest amounts on the surface of ferrite materials prepared by prior art processes. It was found in machine testing that maximum acceptable levels of these surface species is about 20 parts per million for sodium and about 5,000 parts per million for zinc. The excess zinc oxide is usually due to the non-stoichiometry of the ferrite formulation. The major source of sodium contaminant was found to be due to its presence in the materials composition used and especially the deflocculant used in dispersing metal oxide slurries in the initial process steps.

Thus, previously known ferrite preparation precesses and the resultant ferrite materials are deficient for the aforementioned reasons and undoubtedly due to lack of control of the surface properties of the finished product. More particularly, past ferrite material preparation processes and compositions were poorly controlled resulting in ferrites having humidity sensitive surface properties. Further, past ferrite preparation methods were deficient in the ability to control another surface property of ferrites known as BET surface area. BET surface area is measured as the area available for the adsorption of measurable quantities of gases and reflects the surface roughness of the powder product. For use as electrostatographic carrier materials, it is important to have the ability to control product BET area to whatever level is desired for maximum performance, and the ability to produce powder with uniform properties as to particle-to-particle. Since previously known ferrite preparation processes are deficient in one or more respects, there is a continuing need for an improved ferrite production process and for improved ferrite materials.

SUMMARY OF THE INVENTION

It is, therefore, an object of this invention to provide a ferrite manufacturing process and resulting products which overcome the above noted deficiencies.

It is another object of this invention to provide a ferrite manufacturing process which provides humidity-insensitive electrostatographic ferrite carrier materials.

It is another object of this invention to provide a ferrite manufacturing process which limits undesirable hygroscopic surface species on ferrite particles.

it is another object of this invention to provide a ferrite manufacturing process which provides control of the surface properties of ferrite particles.

It is another object of this invention to provide a ferrite manufacturing process which provides improved ferrite carrier particles having more uniform electrostatographic properties.

It is another object of this invention to provide a ferrite manufacturing process which enables the control of BET surface area of ferrite particles.

It is another object of this invention to provide a ferrite manufacturing process wherein ferrite carrier materials having more uniform properties may be prepared. It is another object of this invention to provide a ferrite manufacturing process which is superior to known ferrite manufacturing processes and ferrite carrier particles which are superior to known ferrite carrier particles.

The foregoing objects and others are accomplished, generally speaking, by dry blending ferrite forming metal oxides, calcining the blended oxides to provide them with a saturation magnetic moment of about 6to 30electromagnetic units per gram, milling the calcined oxides in a slurry to reduce their particle size to between about 0.8micron and about 1.6microns while adding manganese oxide, copper oxide, a sodium-free deflocculant, and water to provide a slurry having about 80.0percent by weight of solids, pumping the milled slurry to hold/feed tanks with continuous mixing while adding a binder material to the slurry, spray-drying the slurry to form substantially spherical beads, screening the spray-dried beads to obtain particles having a controlled size, firing the screened beads in air at a temperature of up to about 25000°F. for about 4to about 8hours, deagglomerating the fired beads, and screening the deagglomerated beads to obtain substantially spherical ferrite beads having controlled surface species and physical properties. Optionally, after dry blending the ferrite forming metal oxides, the blend of oxides may be pelletized in the presence of wate. After drying the pelletized oxides, they are then fed to a calciner. Pelletizing the oxides, although not necessary, is desirable to provide uniform, larger particle size of the oxide blend for better flow and heat transfer in rotary calciners. Where the oxide blend is pelletized, the water may optionally be removed from the pellets to avoid the evolution of gas in the form of steam which would interfere with flow and feeding in rotary calciners. In addition, the binder material may be added to the mill during milling of the slurry instead of to the holding/ feeding tanks after milling.

More particularly, the metal oxides are first selected on the basis of desired ferrite composition. The metal oxides are dry blended in a baffled, rotating drum or muller mixer or similar equipment for a time sufficient to obtain a substantially homogeneous mixture. The dry blended metal oxide mixture may then be pelletized, typically with the addition of about 16.0percent by weight of water to the oxide mixture by employing a pelletizer, a muller mixer, or a turbine mixer. Following pelletizing, the metal oxide pellets of about ⅛ inch in diameter may be dried before calcining. In the calcining step, the metal oxide pellets are fired under conditions that complete about 10to about 60percent of the potential ferrite spinel structure. The percent reaction value may be higher or lower, but the selected value should be coordinated with milling time and final firing conditions to obtain a given BET surface area of the final ferrite product. Another consideration is that the higher the percent reaction completion during calcining, the more uniform the final product composition will be, but the calcined material will be less reactive when fed to the final firing step. When following the aforementioned calcination step, the calcined ferrite pellets obtain a saturation magnetic moment of about 6to about 30electromagnetic units/gram of material.

Calcination may be performed in any suitable apparatus such as rotary, inconel-type calciners indirectly fired with electric globars. Such calciners typically have a 6inch internal diameter, are about 90inches long, and are operated at about 7r.p.m. However, other calciners such as a rotary, brick-lined calciner with direct gas firing operated at about 1900° F. have been found suitable. Generally, the maximum calciner temperature is about 2150° F. and the residence time of the pellets is about 30minutes. It has been found that calciner dimensions and rotation usually determine residence time, and residence time and operating temperature determine the magnetic moment of the calcinate for a given oxide composition. An ambient air temperature is suitable during calcination. Obviously, other suitable process conditions and calciner designs may be employed to obtain the same degree of product reaction.

Following calcination, the ferrite pellets are ball-milled with steel media and water to obtain a slurry wherein the calcined pellets are reduced to a controlled size of between about 0.8micron to 1.6microns. The slurry typically contains about 80.0percent by weight of solids. During this step, manganese oxide, copper oxide, and a sodium-free deflocculant are added to the slurry. Milling time is usually about 12hours, depending upon the particle size for a given slurry. The milled slurry is then pumped to holding/feeding tanks with continuous mixing. A binder material is usually added at this point to the slurry, although the binder may be added to the mill as previously indicated.

The next step in the process is to spray-dry the slurry. A spray dryer designed for either spray nozzle atomization or spray machine-disc atomization is employed to dry the slurry. A particularly desirable type of spray machine is one that is essentially a closed pump impeller driven by a variable speed drive and is commonly termed a spinning atomizer, disc or wheel. The high speed impeller uses the energy of centrifugal force to atomize the slurry. The particle size distribution obtained with this spray machine is generally narrow. Preferably, when employing the spinning atomizer, the spray dryer should have a large diameter configuration to avoid sticking of the atomized particles to the dryer chamber walls. The atomizing pressures, or the speed of rotation in the case of wheel atomization, and the slurry feed rates may be varied as a partial control of particle size.

After the slurry has been spray-dried, the spray-dried particles are screened and classified. Those particles which are off-size are fed to a ball-mill for about 2hours of remilling and then fed to the holding/feeding tank. For the screening and classification step, any suitable production screens may be employed. This apparatus typically contains stainless bolting cloth.

Following classification, the partially fired particles are fed to a firing kiln for final firing. Typically, the particles are placed in refractory ceramic boxes called saggers having a capacity of between about 10 and 12 pounds. The saggers employed for firing are typically constructed from alumina or cordierite and are stacked on kiln cars which are pushed through a tunnel kiln. Firing has been performed in kilns over 100feet long, with peak temperature zones of 8to 12feet long. Peak temperature during firing of the particles may be up to about 2500° F. for up to about 4hours. In a kiln where the peak temperature during firing of the particles is about 2350° F., the residence time of the particles is up to about 8hours. In any event, the required firing times for complete reaction and densification of the particles are usually dependent on the size of the kiln, kiln car loading density, and the firing temperature. Air is employed in the firing step of the process of this invention. After cooling, the fired ferrite particles are deagglomerated using a crusher and a granulator. This is followed by a final screening step where particles of a desired size are packaged and where off-size particles are returned to the slurry mill for re-milling.

Thus, in accordance with this invention, improved ferrite materials are provided by preparing ferrite materials by a process wherein the ferrite materials are sintered in the absence of a flow-promoting ingredient such as aluminum oxide or zirconium oxide particles. In addition, the improved ferrite electrostatographic carrier materials are prepared by the use of an essentially stoichiometric starting composition selected for control of bulk properties such as density and saturation magnetic moment, and by the use of starting materials, including a deflocculant, which are essentially sodium-free. The ferrite products of this invention have been found to consistently have surface sodium in an amount of less than about 5parts per million and surface zinc in an amount of less than about 50parts per million. For true stoichiometry, ferric oxide would have a molar ratio of 1.00 with respect to all divalent metal oxides. The actual final formulation may have ferric oxide present with a molar ratio of $1.00 \pm 0.06$. Final formulation may differ from input formulation due to ferric oxide pick-up during milling with steel media. Manganese is usually present in the starting composition because it will assume higher valency in cases of localized iron deficiency and allow completion of a spinel structure rather than the formation of excess zinc oxide and nickel oxide phases. Also, compositions without manganese may result in powders with very high surface zinc concentrations. Low surface zinc concentrations and relatively low BET surface area are important properties for satisfactory electrostatographic carrier performance. Thus, the molde fraction of manganese oxide of the divalent metal oxides in the input composition is usually between about 0.02and about 0.08.Copper is usually present as one means of controlling density, BET surface area, and magnetic moment of the ferrite product.

Thus, ferrite composition uniformity is assured by employing a balanced, essentially stoichiometric formulation. Further, non-spinel phases are minimal. Composition uniformity is further assured by employing calcination in the process of this invention wherein a second mixing and homogenizing of the ferrite elements is performed. In addition, because of the composition uniformity and the significant reduction of surface contaminants, the ferrite materials of this invention may be employed as electrostatographic carriers without a coating thereon, typically, a polymer coating material. Polymer coatings on prior ferrite materials served to cover dielectrically "lossy" surface contaminants which were sensitive to humidity changes. However, where desired, the ferrite materials of this invention may be coated and will provide satisfactory performance in electrostatographic devices.

Another surface property of ferrite electrostatographic carrier materials is very significant as to performance. This surface property is BET surface area. BET surface area may be described as the area available for the adsorption of measurable quantities of gases per methods of Brunauer, Emmett, and Teller, published in 1938. For a given carrier coating process, the BET surface area of ferrite core is a determinant of how well the polymer coating covers the carrier surface and thus The amount of carrier surface which is active in generating a triboelectric charge when mixed with toner particles. It has been found that with prior processes employing flow-promoting igredients in the sintering step, ferrite product BET surface area varied with the condition of the flow-promoting material. Virgin flow-promoting material extracted large amounts of sodium and zinc oxide and thus provided a ferrite surface with very high BET area. That is, ferrite BET surface area could be as high as 350cm$^2$/gram with fresh flow-promoting material and as low as about 200cm$^2$/gram with totally spend flow-promoting material at the same firing conditions. It has been found that the elimination of flow-promoting material in the process of this invention permits better control of BET surface area.

Further, and more specifically, the BET surface area of the ferrite materials of this invention may be controlled by (1) the input composition, (2) the reactivity of the product prior to firing, (3) the density of spray-dried powder, and (4) the actual time and temperature employed for firing. These variables have been translated into controlled process conditions as to (1) the percent of copper and iron present in the input composition; (2) the milled slurry particle size and the saturation moment of the calcinate or slurry particles which affect the reactivity of the powder before firing; (3) the porosity of the powder before firing; and (4) the firing conditions of soak temperature and time at the soak temperature. More particularly, it has been found where copper is not present in the input composition that densification of the powder product and low BET surface area values are very difficult to achieve and are very seldom obtained. In contrast, where more than about 0.03mole fraction of copper is present, the powder product usually agglomerates severely. Where values of iron mole fraction are much below stoichiometry, that is, less than 1.0,such generally promote product non-uniformity and non-spinel phases and also result in high contents of surface zinc species. Further, iron mole fraction values much over stoichiometry prevent good densification and low BET surface area values. Another process variable which may be controlled in the reactivity of the powder product before firing. This may be done by controlling the particle size of the milled slurry and by controlling the saturation moment of the calcinate or slurried particles. Thus, it has been found that large milled slurry particles sizes are unreactive in the final firing step thereby promoting high BET surface area values. On the other hand, small particle sizes are usually difficult to disperse at about 80percent slurry solids with sodium-free deflocculants. In addition, low values of saturation moment of the calcinate, that is, on the order of 0to 8indicate low levels of ferrite pre-reaction in the powder product. However, a high saturation moment reduces the reactivity of the feed calcinate to the firing kiln and promotes high BET surface area values to the powder product. Another process variable having an effect on the BET surface area of the powder product is the density of the spray-dried powder. In general, lower density values indicate large porosity and difficulty in densification during firing. High density values are acceptable, however tend to indicate high-spinel calcinate which would be unreactive in final firing. The firing conditions of soak temperature and time at soak temperature are also important controlled process variables in that low soak temperatures generally will not allow the powder to densify, and short soak times likewise will not allow the powder to densify while long soak periods are uneconomical.

Therefore, in accordance with this invention, it has been found that the following process conditions may be employed for control of the BET surface area of ferrite materials. Thus, as to the mole fraction of copper oxide relative to all divalent metal oxides present in the input composition, a satisfactory range of values is about 0.001 to about 0.100; the preferred range is about 0.010 to about 0.050; and the optimum range is from about 0.018 to about 0.025. As to the mole fraction of ferric oxide relative to all divalent metal oxides present in the input composition, a satisfactory range of values is about 0.80 to about 1.05; the preferred range is about 0.90 to about 1.00; and the optimum range is from about 0.95 to about 0.99. A satisfactory range of saturation moment of the calcinate, in electromagnetic units per gram, is from about 0.1 to about 50; the preferred range is from about 5 to about 40; and the optimum range is from about 10 to about 30. Satisfactory results are obtain when the milled slurry particle size in microns is from about 0.5 to about 3.0, while the preferred range is from about 0.5 to about 2.0, and the optimum range is from about 0.8 to about 1.5. The bulk density of the spray-dried powder in grams per cubic centimeter provides satisfactory results when it is from about 1.4 to about 2.4; the preferred range is from about 1.5 to about 1.8; and the optimum range is from about 1.55 to about 1.70. When employing a tunnel kiln for firing, satisfactory results are obtained when the soak temperature in degrees Fahrenheit is between about 1900° and about 2500° ; while the preferred range between about 2200° and about 2500° ; and the optimum range is between about 2350° and about 2500° . Likewise, satisfactory results are obtained when the time in hours at the soak temperature is between about 2 and about 12; while the preferred range is between about 3 and about 10; and the optimum range is between about 4 and about 8.

It has been found that the aforementioned controls affect densification, product uniformity, grain growth of the ferrite materials during firing, magnetic moment, and the BET surface area of the powder product. The reactivity of ferrite powder prepared for firing is a combination of the extent to which spinel formation has occurred during calcining, and the milled particle size of calcined powder before spray drying. Where calcined material is milled for longer periods of time before spray drying and firing, the ultimate particle size in each dried powder bead will be smaller and promote faster reaction and densification. Higher temperatures or longer residence times during calcining produce more fully reacted calcined powder which is then less reactive in final firing. The production of milled slurries at 80 percent solids are preferred as to achieve high density in spray dried powder, which promotes lower BET area in fired powder. As previously indicated, the BET surface area of ferrite powder is also affected by the firing conditions of time and temperature, and the BET surface area is reduced at higher firing temperatures and longer residence time. It has been found that the BET surface area is a main factor regarding the triboelectric charge generated at a particular carrier coating weight. Thus, by this invention, the BET surface area of ferrite carrier particles may be controlled to provide the proper triboelectric response to carrier particles coated by practically any method.

When a polymer coating is applied to the ferrite carrier materials of this invention, satisfactory results are obtained in a high speed electrostatographic magnetic brush development device where the BET surface area of the uncoated ferrite materials is between about 170 $cm^2$/gram and about 260 $cm^2$/gram. However, it is preferred that the BET surface area be between about 200 $cm^2$/gram and about 250 $cm^2$/gram because the lower values present difficulties in application of coating and the higher values require more coating material to achieve effective charging surfaces. Optimum results are obtained in the aforementioned electrostatographic device when the BET surface area of the ferrite materials to be coated is between about 210 $cm^2$/gram and about 230 $cm^2$/gram. Where a polymer coating is not applied to the fired ferrite powder particles, satisfactory results may be obtained in a high speed electrostatographic magnetic development device when the BET surface area of the ferrite particles is between about 170 $cm^2$/gram and about 500 $cm^2$/gram.

Any suitable type of sintering furnace may be employed in the sintering step of this invention. Typical sintering furnaces include a tunnel kiln, a batch furnace, a rotary kiln, or an agitated bed furnace. The batch and tunnel furnace types are generally employed where long residence times are required.

Firing of the metal oxide spray dried beads at elevated temperatures to complete reaction of the ferrite components is generally carried out between about 2300° F. and about 2500° F. Actually, lower and higher temperatures may be used, but this is dictated by the processing time, the furnace materials of construction generally available, the ferrite formulation, the resulting strength of the fired bead, and the calcining conditions. Generally, if a ferrite carrier material is calcined at about 1900° F for about 30 minutes, the calcinate will obtain a saturation magnetic moment of about 10 electromagnetic units/gram of calcinate, depending upon actual composition. Thus, to obtain a ferrite electrostatographic carrier material having the desired properties, the milled and spary dried calcinate is generally fired at about 2350° F for about 8 hours. The fired ferrite particles will then generally possess a saturation magnetic moment of about 48 emu/g and BET surface area of about 220 $cm^2$/g, depending upon the selected ferrite composition, and uniformity of all properties, particle to particle.

The calcining and firing atmospheres of ambient air are satisfactory to obtain the desired properties of the product of this invention. Thus, the product usually needs not be processed in a reducing gas flame, or a protective gas stream such as hydrogen or nitrogen, a low oxygen atmosphere, or a neutral atmosphere such as nitrogen, or an inert gas atmosphere containing less than 0.2 percent by volume of oxygen as in prior art processes.

In accordance with this invention, any suitable essentially sodium-free deflocculant may be added to the metal oxide mixture during the milling and slurry preparation step. Typical deflocculants include the ammonium salt of polymethacrylic acid, pyrogallic acid, tannic acid and humic acid, and the ammonium salts of tripolyphosphate and hexametaphosphate. However, a deflocculant such as ammonium lignin sulfonate (Orzan A, available from Crown Zellerbach Co.) is preferred because it generally promotes the preparation of a concentrated calcined metal oxide slurry having a solids content of up to about 80 percent by weight in water based on the total weight of the slurry. Further, in spite of this remarkably high solids content, the metal oxide feed slurry may be pumped to the spray dryer and atomized without clogging a pressure nozzle or wheel atomizer. In addition, where about 50 to about 500 micron beads are desirable, the high solid content of the metal oxide slurry contributes to attainment of such particle sizes. Further, the high concentration of oxides reduces the equipment and energy requirements necessary to form the particles. The concentration of deflocculant added to the metal oxide slurry may be varied from about 0.5 to about 2.0 percent by weight based on the weight of the oxide solids.

In addition, any suitable binder material may be added to the milled slurry of metal oxides during milling in ball mills or while the slurry is stored in holding tanks prior to the spray-drying step. Typical binder materials include polyvinyl alcohol, dextrin, lignosulfonates, and methyl cellulose. However, a binder material such as gum arabic, or other natural and synthetic acacia gums are preferred because they generally better preserve the shape and integrity of the atomized metal oxide beads formed during the spray drying and collecting steps of this invention. Further, the binder material may also assist the deflocculant in dispersing the high surface area solids in the slurry. In addition, the presence of a binder material has been found to prevent excessive "dusting", that is, lack of particle cohesion, during the spray drying step. The amount of binder material employed with the slurry of milled metal oxides is usually between about 0.2 to about 1.5 percent by weight based on the weight of the oxide solids, however, about 0.5 percent provides satisfactory results in most cases.

Any suitable substantially stoichiometric ferrite forming metal oxide mixture consistent with desired surface and physical properties may be employed as the starting materials in this invention. Typical starting compositions, on a molar basis, include:

$(NiO_{.33}ZnO_{.67})_{.93}\ MnO_{.05}CuO_{.024}(Fe_2O_3)_{.96}$
$(NiO_{0.3}ZnO_{0.7})_{0.93}\ MnO_{0.05}CuO_{0.02}(Fe_2O_3)_{0.99}$
$NiO_{0.3}ZnO_{0.7} \cdot (Fe_2O_3)_{0.99}$
$NiO_{0.39}ZnO_{0.68}MnO_{0.03} \cdot Fe_2O_{3_{1.0}}$
$NiO_{0.3}ZnO_{0.7} \cdot (Fe_2O_3)_{0.99} + CaO_3$ (1.5% mol)
$(Li_{0.5}Fe_{0.5})O \cdot Fe_2O_3$
$(Li_{0.5}Fe_{0.5})_{0.3}ZnO_{0.7} \cdot Fe_2O_3$
$MnO \cdot Fe_2O_3 + CaO$ (1.5% mol)
$NiO_{0.38}ZnO_{0.57}MnO_{0.03}CuO_{0.07} \cdot Fe_2O_{3_{1.0}}$
$NiO_{0.18}ZnO_{0.45}MgO_{0.3}MnO_{0.05}CuO_{0.06} \cdot Fe_2O_{3_{1.0}}$
$NiO_{0.32}ZnO_{0.56}CuO_{0.09} \cdot Fe_2O_{3_{1.02}}$
$MgO_{0.5}ZnO_{0.3}MnO_{0.05}CuO_{0.1} \cdot Fe_2O_{3_{1.0}}$ When the ferrite composition is to be employed as a carrier material for finely-divided toner particles in an electrostatographic device, it has been found that the values of surface sodium and zinc concentrations are related to starting compositions. Thus, control of these values is desirable where particular surface properties are required. Therefore, in order to obtain less than 20 parts per million of surface sodium in the ferrite particle, all ferrite raw materials should be limited in sodium content. Likewise, the mole fraction of manganese in the input composition is important as it affects acid extractable surface zinc concentrations as previously indicated. Also, product saturation magnetic moment is affected by the mole ratio of the metals.

It is to be understood that numerous modifications of the above formulations may be obtained as is apparent. In any event, the formulations of the starting oxide mixtures should be selected so that after sintering the oxides, the resulting ferrite composition will be substantially stoichiometric as described above. The desired metal oxide materials may be selected on the basis of desired processed ferrite properties and/or economics.

Any suitable polymer coating may be applied to the ferrite carrier particles of this invention. Typical polymer coating materials include natural resin, thermoplastic resin, or partially cured thermosetting resin. Typical natural resins include: caoutchouc, colophony, copal, dammar, dragon's blood, jalop, storax, and mixtures thereof. Typical thermoplastic resins include: the polyolefins such as polyethylene, polypropylene, chlorinated polyethylene, and chlorosulfonated polyethylene; polyvinyls and polyvinylidenes such as polystyrene, polymethylstyrene, polymethylmethacrylate, polyacrylonitrile, polyvinylacetate, polyvinylalcohol, polyvinylbutyral, polyvinylchloride, polyvinylcarbazole, polyvinyl ethers, and polyvinyl ketones; fluorocarbons such as polytetrafluoroethylene, polyvinylfluoride, polyvinylidene fluoride; and polychlorotrifluoroethylene; polyamides such as polycaprolactamo and polyhexamethylene adipimide; polyesters such as polyethylene terephthalate; polyurethanes; polysulfides; polycarbonates; and mixtures thereof. Typical thermosetting resins include: phenolic resins such as phenol formaldehyde, phenol furfural and resorcinol formaldehyde; amino resins such as urea formaldehyde and melamine formaldehyde; polyester resins; epoxy resins, and mixtures thereof. A styrenemethacrylate-organosilicon terpolymer carrier coating composition such as described in U.S. Pat. No 3,526,533 is particularly preferred because of its excellent triboelectric characteristics. The ferrite carrier materials of this invention may be coated with carrier coating material by any conventional carrier coating technique, such as, for example, the technique described in U.S. Pat. No. 2,618,551.

An ultimate carrier particle diameter between about 50 microns to about 1,000 microns is generally preferred because the carrier particles then possess sufficient density and inertia to avoid adherence to the electrostatographic recording surface during the development process. Adherence of carrier beads to electrostatographic drums is undesirable because of the formation of deep scratches on the surface during the imaging transfer and drum cleaning steps, particularly where cleaning is accomplished by a web cleaner such as the web disclosed by W. P. Graff, Jr., et al in U.S. Pat. No. 3,186,838. Also print deletion occurs when carrier beads adhere to electrostatographic imaging surfaces.

Any suitable electrostatographic carrier coating thickness may be employed. However, a carrier coating having a thickness at least sufficient to form a thin continuous film on the carrier bead is preferred because the carrier coating will then possess sufficient thickness to resist abrasion and prevent pinholes which adversely affect the triboelectric properties of the coated carrier particles. Generally, the carrier coating material may comprise from about 0.01 percent to about 1.0 percent by weight based on the weight of the coated carrier particles. Preferably, the electrostatographic carrier coating material should comprise from about 0.3 percent to about 0.7 percent by weight based on the weight of the coated carrier particles because maximum durability, triboelectric response, and copy quality are achieved. To achieve further variation in the properties of the coating materials, well-known additives such as plasticizers, reactive and non-reactive polymers, dyes, pigments, wetting agents, and mixtures thereof may be mixed with the carrier coating material.

Any suitable pigmented or dyed electroscopic toner material may be employed with the ferrite carrier materials produced in accordance with this invention. Typical toner materials include: gum copal, gum sandarac, rosin, cumaroneindene resin, asphaltum, gilsonite, phenolformaldehyde resins, rosin-modified phenolformaldehyde resins, methacrylic resins, polystyrene resins, polypropylene resins, epoxy resins, polyethylene resins and mixtures thereof. The particular toner material to be employed obviously depends upon the separation of the toner particles from the ferrite carrier materials in the triboelectric series. As is well known in the art, sufficient separation should exist to permit the toner to electrostatically cling to the surface of the carrier. Among the patents describing electroscopic toner compositions are U.S. Pat. No. 2,659,670 to Copley; U.S. Pat. No. 2,753,308 to Landrigan, U.S. Pat. No. 3,079,342 to Insalaco; U.S. Pat. No. Re. 25,136 to Carlson and U.S. Pat. No. 2,788,288 to Rheinfrank et al. These toner materials generally have an average particle diameter between about 1 and about 30 microns. Generally speaking, satisfactory results are obtained when about 1 part toner is used with about 10 to about 200 parts by weight of carrier.

When the ferrite materials of this invention are mixed with finely-divided toner materials and employed as a developer mixture in an electrostatographic device, it is found that the developer mixture is not sensitive to high humidity conditions and consequently provide much lower levels of background deposits on developed electrostatic latent images, and also provide greatly increased developer life which now results in their successful commerical use in high speed electrostatographic devices.

DESCRITPITON OF THE PREFERRED EMBODIMENTS

The following examples further define, describe and compare exemplary methods of preparing ferrite materials according to the process of the present invention. Parts and percentages are by weight unless otherwise indicated. The examples, other than the control examples, are intended to illustrate the various preferred embodiments of the present invention.

In the following examples, the unit employed for spray drying is a large diameter spray dryer with centrifugal atomization. Primary collection in this unit is in the dryer chamber, with secondary collection in cyclones, filters, and scrubbers. The dryer chamber is about 16 feet in diameter. Spinning wheel atomization is downward from the top center of the dryer. The incoming air is heated by direct gas firing.

EXAMPLE I

A control composition comprising about 46 mole percent of ferric iron oxide, about 38 mole percent of zinc oxide, and about 16 mole percent of nickel oxide is added to a grinding mill containing steel media. The sodium salt of a polymethacrylic acid (Darvan 7, available from R. T. Vanderbilt Company) is added to comprise about 0.8 percent by weight (solids basis). Water is added such that the resulting slurry is 80 percent solids by weight. The slurry is mixed in te ball mill for about 4 hours. The slurry mixture is transferred to a holding tank wherefrom it is fed to the aforementioned spray dryer at a feed rate of about 2500 pounds per hour, a drying air input temperature of about 575° F., and an outlet temperature of about 325° F. After spray drying, the substantially sperhical metal oxide beads are screened and the offsize material is returned to the slurry make-up tank for reprocessing. The sized material having an average particle diameter of about 100 microns is then blended with a flow-promoting ingredient, in this case, aluminum oxide particles, of approximately 600 microns size and in a weight ratio of about 1:1. The blend is then loaded into saggers (alumina boxes) which hold about 12 to 14 pounds of material. The saggers are stacked on kiln cars which are pushed through a tunnel kiln and fired for about 4 hours at a peak temperature of about 2300° F. During the period of peak temperature firing and during the period of cooling from peak temperature, oxygen in the firing atmosphere is controlled to decrease from about 10 percent to about 1 percent. After cooling, the saggers cake is deagglomerated with a crusher, followed by a coarse screen process to separate ferrite particles from the aluminum oxide particles. The aluminum oxide particles are returned to be blended and fired again with metal oxide particles as many as 10 additional times. The ferrite particles are screened again and classified as to desirable particle size. Fired offsize material is discarded. The classified ferrite particles were analyzed for surface species of sodium and zinc and were found to contain from about 2 to about 80 ppm. of sodium and from about 500 to about 10,000 ppm. of zinc. Analysis for sodium is performed by a water extraction method, and for zinc by an acid method. The saturation magnetic moment of the ferrite particles was found to be about 55 electromagnetic units/gram of ferrite material. Upon analysis employing krypton gas as the adsorbate, the BET surface area of the ferrite particles was found to range from about 180 to about 350 $cm^2$/gram.

EXAMPLE II

The classified ferrite material of Example I was employed as a carrier for a toner material in a high speed electrostatographic magnetic brush device for the development of electrostatic latent images. The toner material employed comprises a copolymer of styrene and alkyl methacrylate with a carbon black wherein the toner material has an average particle size of about 10 to about 15 microns. A polymer material comprising a styrene, alkyl methacrylate, and an organosilicon as described in U.S. Pat. No. 3,526,533 is coated on the ferrite particles in a coating weight of about 0.6 percent. The coated ferrite carrier particles are blended with the toner material in an amount of about 1 part toner material per about 100 parts of carrier material. The developer mixture is used to develop a selenium photoconductor carrying an electrostatic latent image by the "magnetic brush" development method described in U.S. Pat. No. 2,874,063. The magnetic field of the magnet causes alignment of the carrier and toner into a brush-like configuration. The magnetic brush is brought into developing configuration with the electrostatic image-bearing surface and toner particles are drawn from the carrier particles to the latent image by electrostatic attraction. The ambient temperature was about 80° F. and the relative humidity was about 80 percent during development of the electrostatic latent images. It is found that the developer mixture produces image background levels considerably above the maximum value of 0.010 deemed acceptable as measured by a standard reference scale.

EXAMPLE III

Ferrite electrostatographic carrier materials were prepared by dry blending a quantity of metal oxides about 53 mole percent of ferric iron oxide, about 31 mole percent of zinc oxide, and about 16 mole percent of nickel oxide in a baffled, rotating drum for about 20 minutes. The dry blended metal oxide mixture was then pelletized in a turbine mixer to which was added about 15 percent by weight of water. Metal oxide pellets of about ⅛ inch diameter and finer in size were obtained and were dried in a continuous belt dryer to about 2 percent by weight water. After drying, the pellets were calcined for about 30 minutes in an air atmosphere at a peak temperature of about 2150° F. The calcined pellets were found to have a saturation magnetic moment of about 30 electromagnetic units/gram of material. The calcined pellets were than placed in a grinding mill containing steel media. Additional metal oxides and ammonium lignin sulfonate were added to the mill such that the total metal oxide composition in the mill was about 96 mole percent calcined formulation, about 3 mole percent manganese oxide and about 1 percent copper oxide. In addition, the ammonium lignin sulfonate constituted about 1 percent by weight of all solids. Water was then added to obtain a slurry containing about 80 percent by weight of solids. After milling for about 15 hours the pellets are reduced in size to about 1.5 microns and the slurry is transferred to hold/feed tanks with continuous stirring where about 0.5 weight percent (solids basis) of gum arabic, a soluble, natural acacia gum, is added to the slurry.

The slurry is then fed to the aforementioned spray dryer unit where it is spray dried into partices having an average diameter of about 100 microns. The feed rate to the spray dryer is about 2500 pounds slurry per hours, the drying air input temperature is about 575° F., and the outlet temperature is about 325° F. After spray drying, the metal oxide beads are screened and the offsize material is fed to a separate milling device for reprocessing. The sized material is then loaded into saggers which are stacked on kiln cars and pushed through a tunnel kiln where the beads are fired for about 4 hours in an air atmosphere at a peak temperature of about 2450° F. After cooling, the ferrite particles are deagglomerated using a crusher and a granulator, and then screened again to the desired particle size. In this case, ferrite particles having an average particle diameter of about 100 microns were selected. The offsize material was returned to the slurry mill for reprocessing.

The classified ferrite particles were analyzed for surface species of sodium and zinc and were found to contain, on the average, about 2 ppm. of sodium and about 15 ppm. of zinc. In addition, the saturation magnetic moment of the ferrite particles was found to be about 48 electromagnetic units/gram of material. Further, the ferrite particles were analyzed for BET surface area which was found to be an average value of about 220 $cm^2$/gram.

EXAMPLE IV

The classified ferrite particles of Example III were employed as a carrier in a developer mixture as in Example II. The ferrite particles were coated as in Example II and the toner material was the same in Example II. The carrier-toner ratio was the same in Example II. The ambient temperature was about 80° F. and the relative humidity was about 80 percent during development of the electrostatic latent images. It was found that the developer mixture produced images of excellent quality with satisfactory background levels well below the maximum value of 0.010 deemed acceptable.

EXAMPLE V

Ferrite electrostatographic carrier materials were prepared by dry blending a quantity of metal oxides comprising about 53 mole percent of ferric iron oxide, about 31 mole percent of zinc oxide, and about 16 mole percent of nickel oxide in a baffled, rotating drum for about 20 minutes. The dry blended metal oxide mixture was then pelletized in a turbine mixer to which was added about 15 percent by weight of water. Metal oxide pellets of about ⅛ inch diameter and finer in size were obtained and were dried in a continuous belt dryer to about 2 percent by weight water. After drying, the pellets were calcined for about 30 minutes in an air atmosphere at a peak temperature of about 1900° F. The calcined pellets were found to have a saturation magnetic moment of about 7 electromagnetic units/gram of material. The calcined pellets were then placed in a grinding mill containing steel media. Additional metal oxides and ammonium lignin sulfonate were added to the mill such that the total metal oxide composition in the mill was about 96 mole percent calcined formulation, about 3 mole percent manganese oxide and about 1 percent copper oxide. In addition, the ammonium lignin sulfonate constituted about 1 percent by weight of all solids. Water was then added to obtain a slurry containing about 80 percent by weight of solids. After milling for about 12 hours, the pellets are reduced in size to about 1 micron and the slurry is transferred to holding/feeding tanks with continuous stirring where about 0.5 weight percent (solids basis) of gum arabic, a soluble, natural acacia gum, is added to the slurry.

The slurry is then fed to the aforementioned spray dryer unit where is is spray-dried into particles having an average diameter of about 100 microns. The feed rate to the spray dryer is about 2500 pounds of slurry per hour, the drying air input temperature is about 575° F, and the outlet temperature is about 325° F. After spray drying, the metal oxide beads are screened and the offsize material is fed to a separate milling device for reprocessing. The sized material is then loaded into saggers which are stacked on kiln cars and pushed through a tunnel kiln where the beads are fired for about 8 hours in an air atmosphere at a peak temperature of about 2350° F. After cooling, the ferrite particles are deagglomerated using a crusher and a granulator, and then screened again to the desired particle size. In this case, ferrite particles having an average particle diameter of about 100 microns were selected. The offsize material was returned to the slurry mill for reprocessing.

The classified ferrite particles were analyzed for surface species of sodium and zinc and were found to contain, on the average, about 2 ppm. of sodium and about 25 ppm. of zinc. In addition, the saturation magnetic moment of the ferrite particles was found to be about 48 electromagnetic units/gram of material. Further, the ferrite particles were analyzed for BET surface area which was found to be an average value of about 220 $cm^2$/gram.

EXAMPLE VI

The classified ferrite particles of Example V were employed as a carrier in a developer mixture as in Example II. The ferrite particles were coated as in Example II and the toner material was the same as in Example II. The carrier-toner ratio was the same as in Example II. The ambient temperature was about 80° F. and the relative humidity was about 80 percent during development of the electrostatic latent images. It was found that the developer mixture produced images of excellent quality with satisfactory background levels well below the maximum value of 0.010 deemed acceptable.

EXAMPLE VII

Ferrite electrostatographic carrier material were prepared by dry blending a quantity of metal oxides about 51 mole percent of ferric iron oxide, about 34 mole percent of zinc oxide, and about 15 mole percent of nickel oxide in a baffled, rotating drum for about 20 minutes. The dry blended metal oxide mixture was then pelletized in a turbine mixer to which was added about 15 percent by weight of water. Metal oxide pellets of about ⅛ inch diameter and finer in size were obtained and were dried in a continuous belt dryer to about 2 percent by weight water. After drying, the pellets were calcined for about 30 minutes in an air atmosphere at a peak temperature of about 2150° F. The calcined pellets were found to have a saturation magnetic moment of about 30 electromagnetic units/gram of material. The calcined pellets were then placed in a grinding mill containing steel media. Manganese oxide and ammonium lignin sulfonate were added to the mill such that the total metal oxide composition in the mill was about 98.5 mole percent calcined formulation, and about 1.5 mole percent manganese oxide. In addition, the ammonium lignin sulfonate constituted about 1 percent by weight of all solids. Water was then added to obtain a slurry containing about 80 percent by weight of solids. After milling for about 15 hours, the pellets are reduced in size to about 1.5 microns and the slurry is transferred to holding/feeding tanks with continuous stirring where about 0.5 weight percent (solids basis) of gum arabic, a soluble, natural acacia gum, is added to the slurry.

The slurry is then fed to the aforementioned spray dryer unit where it is spray-dried into particles having an average diameter of about 100 microns. The feed rate to the spray dryer is about 2500 pounds of slurry per hour, the drying air input temperature is about 575° F., and the outlet temperature is about 325° F. After spray drying, the metal oxide beads are screened and the offsize material is fed to a separate milling device for reprocessing. The sized material is then loaded into saggers which are stacked on kiln cars and pushed through a tunnel kiln where the beads are fired for about 4 hours in an air atmosphere at a peak temperature of about 2450° F. After cooling, the ferrite particles are deagglomerated using a crusher and a granulator, and then screened again to the desired particle size. In this case, ferrite particles having an average particle diameter of about 100 microns were selected. The offsize material was returned to the slurry mill for reprocessing.

The classified ferrite particles were analyzed for surface species of sodium and zinc and were found to contain, on the average, about 3 ppm. of sodium and about 7 ppm. of zinc. In addition, the saturation magnetic moment of the ferrite particles was found to be about 36 electromagnetic units/gram of material. Further, the ferrite particles were analyzed for BET surface area which was found to be an average value of about 250 $cm^2$/gram.

EXAMPLE VIII

The classified ferrite particles of Example VII were employed as a carrier in a developer mixture as in Example II. The ferrite particles were coated as in Example II and the toner material was the same as in Example II. The carrier-toner ratio was the same in Example II. The ambient temperature was about 80° F. and relative humidity was about 80 percent during development of the electrostatic latent images. It was found that the developer mixture produced images of excellent quality with background levels well below the maximum value of 0.010 deemed acceptable.

EXAMPLE IX

Ferrite electrostatographic carrier material were prepared by dry blending a quantity of metal oxides comprising about 53 mole percent of ferric iron oxide, about 31 mole percent of zinc oxide, and about 16 mole percent of nickel oxide in a muller mixer for about 20 minutes. The blended powder was calcined for about 30 minutes in an air atmosphere at a peak temperature of about 1900° F. The calcined material was found to have a saturation magnetic moment of about 7 electromagnetic units/gram of material. The calcined material was then placed in a grinding mill containing steel media. Additional metal oxides, ammonium lignin sulfonate, and gum arabic were added to the mill such that the total metal oxide composition in the mill was about 96 mole percent calcined formulation, about 3 mole percent manganese oxide, and about 1 percent copper oxide. In addition, the ammonium lignin sulfonate constituted about 1 percent by weight of all solids, and the gum arabic constituted about 0.5 percent by weight of all solids. Water was then added to obtain a slurry containing about 80 percent by weight of solids. After milling for about 12 hours, the pellets are reduced in size to about 1 microns and the slurry is transferred to holding/feeding tanks with continuous stirring.

The slurry is then fed to the aforementioned spray dryer unit where it is spray dried into particles having an average diameter of about 100 microns. The feed rate to the spray dryer is about 2500 pounds of slurry per hour, the drying air input temperature is about 575° F., and the outlet temperature is about 325° F. After spray drying, the metal oxide beads are screened and the offsize material is fed to a separate milling device for reprocessing. The sized material is then loaded into saggers which are stacked on kiln cars and pushed through a tunnel kiln where the beads are fired for about 8 hours in an air atmosphere at a peak temperature of about 2350° F. After cooling, the ferrite particles are deagglomerated using a crusher and a granulator, and then screened again to the desired particle size. In this case, ferrite particles having an average particle diameter of about 100 microns were selected. The offsize material was returned to the slurry mill for reprocessing.

The classified ferrite particles were analyzed for surface species of sodium and zinc and were found to contain, on the average, about 2 ppm. of sodium and about 25 ppm. of zinc. In addition, the saturation magnetic moment of the ferrite particles was found to be about 48 electromagnetic units/gram of material. Further, the ferrite particles were analyzed for BET surface area which was found to be an average value of about 220 $cm^2$/gram.

EXAMPLE X

The classified ferrite particles of Example IX were employed as a carrier in a developer mixture as in Example II. The ferrite particles were coated as in Example II and the toner material was the same as in Example II. The carrier-toner ratio was the same as in Example II. The ambient temperature was about 80° F. and the relative humidity was about 80 percent during development of the electrostatic latent images. It was found that the developer mixture produced images of excellent quality with background levels well below the maximum value of 0.010 deemed acceptable.

Although specific materials and conditions are set forth in the above examples of making the ferrite materials of this invention, these are merely intended as illustrations of the present invention. These and other ferrite materials, solvents, substitutents, and processes, such as those listed above, may be subsituted for those in the Examples with similar results.

Other modifications of the present invention will occur to those skilled in the art upon a reading of the present disclosure. These are intended to be included within the scope of this invention.

What is claimed is:

1. Humidity-insensitive electrostatographic ferrite carrier materials having an average particle diameter from between about 30 to about 1,000 microns, said carrier materials having been prepared by blending an essentially stoichiometric mixture of ferrite forming metal oxides, calcining the blended oxides in air at a temperature of up to about 2150° F. for up to about 30 minutes to provide said blended oxides with a saturation magnetic moment of between about 6 to about 30 electromagnetic units per gram, milling the calcined oxides in a slurry to reduce the particle size of said calcined oxides to between about 0.8 microns and about 1.6 microns, adding to said slurry from about 0.02 to about 0.08 mole fraction of manganese oxide and about 0.001 to about 0.100 mole fraction of copper oxide based on all divalent metal oxides, adding sodium-free deflocculant to said slurry in an amount of from about 0.5 to about 2.0 percent by weight based on the weight of said metal oxides, adding water to said slurry to provide a slurry having about 80.0 percent by weight of solids, pumping said slurry to hold/feed tanks with continuous mixing while adding a binder material to said slurry in an amount of from about 0.2 to about 1.5 percent by weight based on the weight of said metal oxides, spray-drying said slurry to form substantially spherical beads, screening said beads to obtain particles having a controlled size, firing said particles in air at a temperature of up to about 2500° F. for about 4 to about 8 hours to provide them with a saturation magnetic moment of about 48 electromagnetic units per gram, deagglomerating said particles, and screening said particles to obtain ferrite particles characterized as having surface sodium in an amount of less than about 20 parts per million, surface zinc in an amount of less than about 5,000 parts per million, and a BET surface area of between about 170 $cm^2$/gram and about 500 $cm^2$/gram.

2. Humidity-insensitive electrostatographic ferrite carrier materials prepared in accordance with claim 1 wherein said blend of oxides have been pelletized in the presence of water prior to calcining said blended oxides.

3. Humidity-insensitive electrostatographic ferrite carrier materials prepared in accordance with claim 2 wherein said pelletized blend of oxides have been dried prior to calcination of said pelletized oxides.

4. Humidity-insensitive electrostatographic ferrite carrier materials prepared in accordance with claim 1 wherein said sodium-free deflocculant is selected from the group consisting of the ammonium salt of polymethacrylic acid, pyrogallic acid, tannic acid and humic acid, and the ammonium salts of tripolyphosphate and hexametaphosphate.

5. Humidity-insensitive electrostatographic ferrite carrier materials prepared in accordance with claim 1 wherein said sodium-free deflocculant comprises ammonium lignin sulfonate.

6. Humidity-insensitive electrostatographic ferrite carrier materials prepared in accordance with claim 1 wherein said binder material is selected from the group consisting of polyvinyl alcohol, dextrin, lignosulfonates, and methyl cellulose.

7. Humidity-insensitive electrostatogrpahic ferrite carrier materials prepared in accordance with claim 1 wherein said binder material comprises gum arabic.

8. Humidity-insensitive electrostatographic ferrite carrier materials prepared in accordance with claim 1 wherein said essentially stoichiometric mixture of metal oxides comprises the molar formulation $(NiO_{.33}\text{-}ZnO_{.67})_{.93}MnO_{.05}CuO_{.024}(Fe_2O_3)_{.96}$.

9. Humidity-insensitive electrostatographic ferrite carrier materials prepared in accordance with claim 1 wherein said essentially stoichiometric mixture of metal oxides comprises the molar formulation $(NiO_{0.3}\text{-}ZnO_{0.7})_{0.93}MnO_{0.05}CuO_{0.02}(Fe_2O_3)_{0.99}$.

10. Humidity-insensitive electrostatographic ferrite carrier materials prepared in accordance with claim 1 wherein said essentially stoichiometric mixture of metal oxides comprises the molar formulation $NiO_{0.18}\text{-}ZnO_{0.45}MgO_{0.3}MnO_{0.05}CuO_{0.06} \cdot Fe_2O_3$.

11. Humidity-insensitive electrostatographic ferrite carrier materials prepared in accordance with claim 1 wherein said essentially stoichiometric mixture of metal oxides comprises the molar formulation $MgO_{0.5}\text{-}ZnO_{0.3}MnO_{0.05}CuO_{0.1} \cdot Fe_2O_3$.

12. Humidity-insensitive electrostatographic ferrite carrier materials prepared in accordance with claim 1 wherein a coating of a polymer material has been applied to said ferrite particles.

13. An electrostatographic developer mixture comprising finely-divided toner particles electrostatically clinging to the surface of carrier particles, said carrier particles comprising humidity-insensitive ferrite beads having an average particle diameter of from between about 30 to about 1,000 microns, said carrier particles having been prepared by blending an essentially stoichiometric mixture of ferrite forming metal oxides, calcining the blended oxides in air at a temperature of up to about 2150° F. for up to about 30 minutes to provide said blended oxides with a saturation magnetic moment of between about 6 to about 30 electromagnetic units per gram, milling the calcined oxides in a slurry to reduce the particle size of said calcined oxides to between about 0.8 microns and about 1.6 microns, adding to said slurry from about 0.02 to about 0.08 mole fraction of manganese oxide and about 0.001 to about 0.100 mole fraction of copper oxide based on all divalent metal oxides, adding a sodium-free deflocculant to said slurry in an amount of from about 0.5 to about 2.0 percent by weight based on the weight of said metal oxides, adding water to said slurry to provide a slurry having about 80.0 percent by weight of solids, pumping said slurry to hold/feed tanks with continuous mixing while adding a binder material to said slurry in an amount of from about 0.2 to about 1.5 percent by weight based on the weight of said metal oxides, spray-drying said slurry to form substantially spherical beads, screening said beads to obtain particles having a controlled size, firing said particles in air at a temperature of up to about 2500° F. for about 4 to about 8 hours to provide them with a saturation magnetic moment of about 48 electromagnetic units per gram, deagglomerating said particles, and screening said particles to obtain ferrite particles characterized as having surface sodium in an amount of less than about 20 parts per million, surface zinc in an amount of less than about 5,000 parts per million, and a BET surface area of between about 170 $cm^2$/gram and about 500 $cm^2$/gram.

14. An electrostatographic imaging process comprising the steps of forming an electrostatic latent image on a surface and developing said electrostatic latent image by contacting said electrostatic latent image with a developer mixture comprising finely-divided toner particles electrostatically clinging to the surfaces of carrier particles, said carrier particles comprising humidity-insensitive ferrite beads having an average particle diameter from between about 30 to about 1,000 microns, said carrier particles having been prepared by blending an essentially stoichiometric mixture of ferrite forming metal oxides, calcining the blended oxides in air at a temperature of up to about 2150° F. for up to about 30 minutes to provide said blended oxides with a saturation magnetic moment of between about 6 to about 30 electromagnetic units per gram, milling the calcined oxides in a slurry to reduce the particle size of said calcined oxides to between about 0.8 microns and about 1.6 microns, adding to said slurry from about 0.02 to about 0.08 mole fraction of manganese oxide and about 0.001 to about 0.100 mole fraction of copper oxide based on all divalent metal oxides, adding a sodium-free deflocculant to said slurry in an amount of from about 0.5 to about 2.0 percent by weight based on the weight of said metal oxides, adding water to said slurry to provide a slurry having about 80.0 percent by weight of solids, pumping said slurry to hold/feed tanks with continuous mixing while adding a binder material to said slurry in an amount of from about 0.2 to about 1.5 percent by weight based on the weight of said metal oxides, spray-drying said slurry to form substantially spherical beads, screening said beads to obtain particles having a controlled size, firing said particles in air at a temperature of up to about 2500° F. for about 4 to about 8 hours to provide them with a saturation magnetic moment of about 48 electromagnetic units per gram, deagglomerating said particles, and screening said particles to obtain ferrite particles characterized as having surface sodium in an amount of less than about 20 parts per million, surface zinc in an amount of less than about 5,000 parts per million, and a BET surface area of between about 170 $cm^2$/gram and about 500 $cm^2$/gram, whereby at least a portion of said finely-divided toner particles are attracted to and held on said surface in conformance to said electrostatic latent image.

* * * * *